US005573329A

United States Patent [19]

van Gennep

[11] Patent Number: 5,573,329

[45] Date of Patent: Nov. 12, 1996

[54] LIGHT SOURCE HOLDER

[76] Inventor: Jan van Gennep, 715 Laurel Ave., Menlo Park, Calif. 94025

[21] Appl. No.: 361,594

[22] Filed: Dec. 22, 1994

[51] Int. Cl.[6] ..... F21L 7/00

[52] U.S. Cl. ..... 362/191; 362/396; 362/421; 362/427; 248/229.13; 248/288.31

[58] Field of Search ..... 362/191, 396, 362/418, 421, 427, 119; 248/288.31, 229.13, 229.1, 231.51, 226.11; 81/367, 368, 377

[56] References Cited

U.S. PATENT DOCUMENTS

| | | | |
|---|---|---|---|
| 1,141,152 | 6/1915 | Stahl | 362/396 |
| 1,562,994 | 11/1925 | Stewart | 362/396 |
| 1,684,347 | 9/1928 | Dobbs | 248/229 |
| 1,807,501 | 5/1931 | Alexander | 248/229 |
| 1,865,127 | 6/1932 | McKeen | 362/191 |
| 2,287,485 | 6/1942 | Pierce | 248/231.5 |
| 3,111,296 | 11/1963 | Ludes | 248/231.5 |
| 5,203,797 | 4/1993 | Petersen | 81/367 |
| 5,303,133 | 4/1994 | Wagner | 362/191 |

*Primary Examiner*—Denise L. Gromada
*Assistant Examiner*—Sara Sachie Raab
*Attorney, Agent, or Firm*—Flehr, Hohbach, Test, Albritton & Herbert

[57] ABSTRACT

A holder is described for maintaining a flashlight or other instrumentality at a desired location. The holder includes an interface unit which is securable to a gripping device, such as vise grip pliers. A connector for the instrumentality also is provided as part of the combination, which connector is attachable to the interface unit.

19 Claims, 3 Drawing Sheets

LIGHT SOURCE HOLDER

BACKGROUND OF THE INVENTION

The present invention relates to an adapter for holding an instrumentality, such as a flashlight, at a desired location and, more particularly, to such an adapter which does not interfere with adjustment.

There is a type of flashlight whose focusing can be changed to enable the same to illuminate a particular spot irrespective of the location (within reasonable limits) of the flashlight itself. Examples of this type are the flashlights made by Mag Instruments, Inc. of Ontario, Calif. and distributed with the trademark MINI-MAGLITE.

Focusing flashlights are now finding wide usage by carpenters, mechanics, and others involved in creating or fixing houses, engines, etc. One problem with their use is that it is still necessary to hold the same at a location from which light from the flashlight can be focused to the area or spot desired to be illuminated. If the flashlight is held by a human with one of his/her hands, the hand most often will not also be usable to help in conducting an operation at the point illuminated. Because of such, some have even stooped to holding the flashlight with their teeth in order to free a hand so that both hands can be used to perform a desired operation.

SUMMARY OF THE INVENTION

The present invention relates to a holder which facilitates the mounting and holding of a flashlight or other instrumentality at a desired location. Such holder includes an adapter which is securable to the instrumentality, and a gripper which is secured to the adapter and grips structure adjacent the location at which the instrumentality is to be held. The adapter itself includes a combination of parts which facilitates the desired holding. That is, it includes an interface unit which provides securance to a gripping device which, in turn, grips structure adjacent the location, and a connector for attaching the flashlight or other instrumentality to the interface unit. Most desirably, the gripping device is one which includes an adjustment mechanism. Such gripping device preferably is a pair of vise grip pliers. Pliers of this type provide not only the adjustment mechanism as described above, but also require little space for operation and can be secured to many different structures, including ones which have a minimum of grippable configuration.

The interface unit is securable to the gripping device at a position selected so as to prevent it from interfering with adjustment of the gripping device. This is easily accomplished by the interface unit being directly secured to the adjustment mechanism itself. Most desirably, the connector is rotatable relative to the interface unit to facilitate such adjustment and positioning of the holder.

The adapter of the invention is useful with instrumentalities besides flashlights, e.g., cameras. Moreover, some tools, e.g., electric drills, themselves can hold a light source. In such a situation, the holder is securable to the tool itself. In some instances it simply can be a strap which circumscribes the tool. The invention also includes a method of illumination which requires mounting of the flashlight or other light source at the desired location.

Other features and advantages of the invention either will become apparent or will be described in connection with the following, more detailed description of preferred embodiments of the invention.

BRIEF DESCRIPTION OF THE DRAWING

With reference to the accompanying drawing.

DETAILED DESCRIPTION OF THE PREFERRED EMBODIMENTS

The following relatively detailed description is provided to satisfy the patent statutes. It will be appreciated by those skilled in the art, though, that various changes and modifications can be made without departing from the invention.

Figure 1:
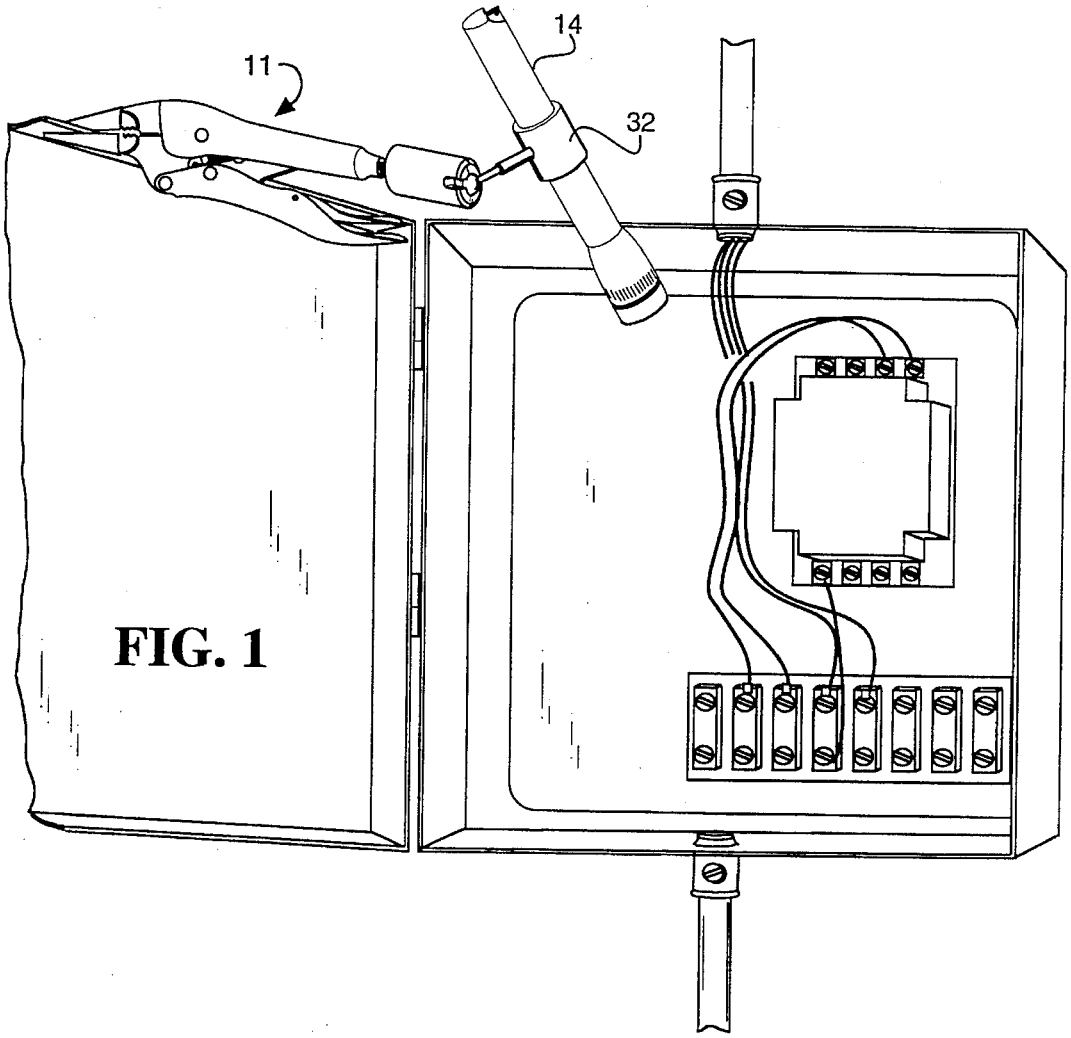
FIG. 1 is an isometric view illustrating use of a preferred embodiment of the invention to maintain a flashlight in position for illuminating a desired location.
Figure 3:
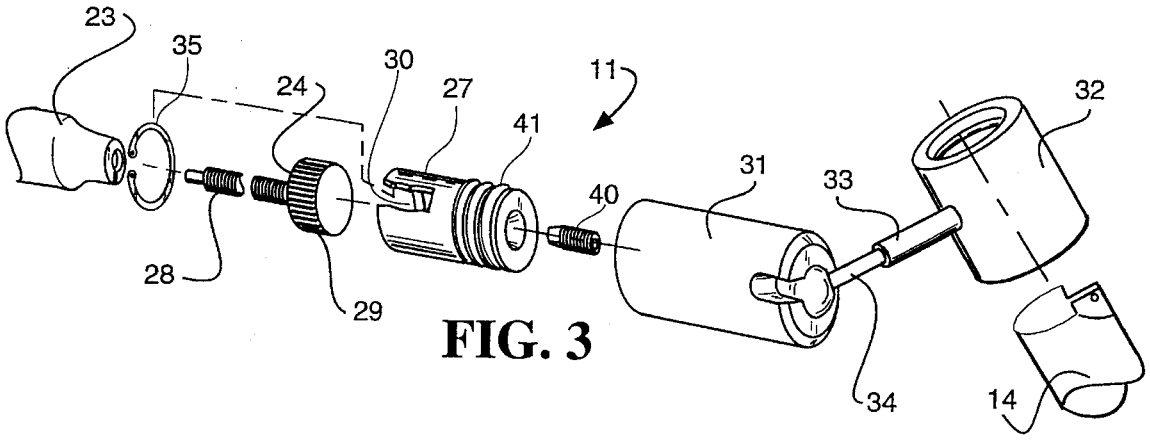
FIG. 3 is an exploded partial isometric view illustrating the manner in which an adapter of the embodiment of FIG. 1 is securable to the handle of vise grip pliers.
Figure 2:
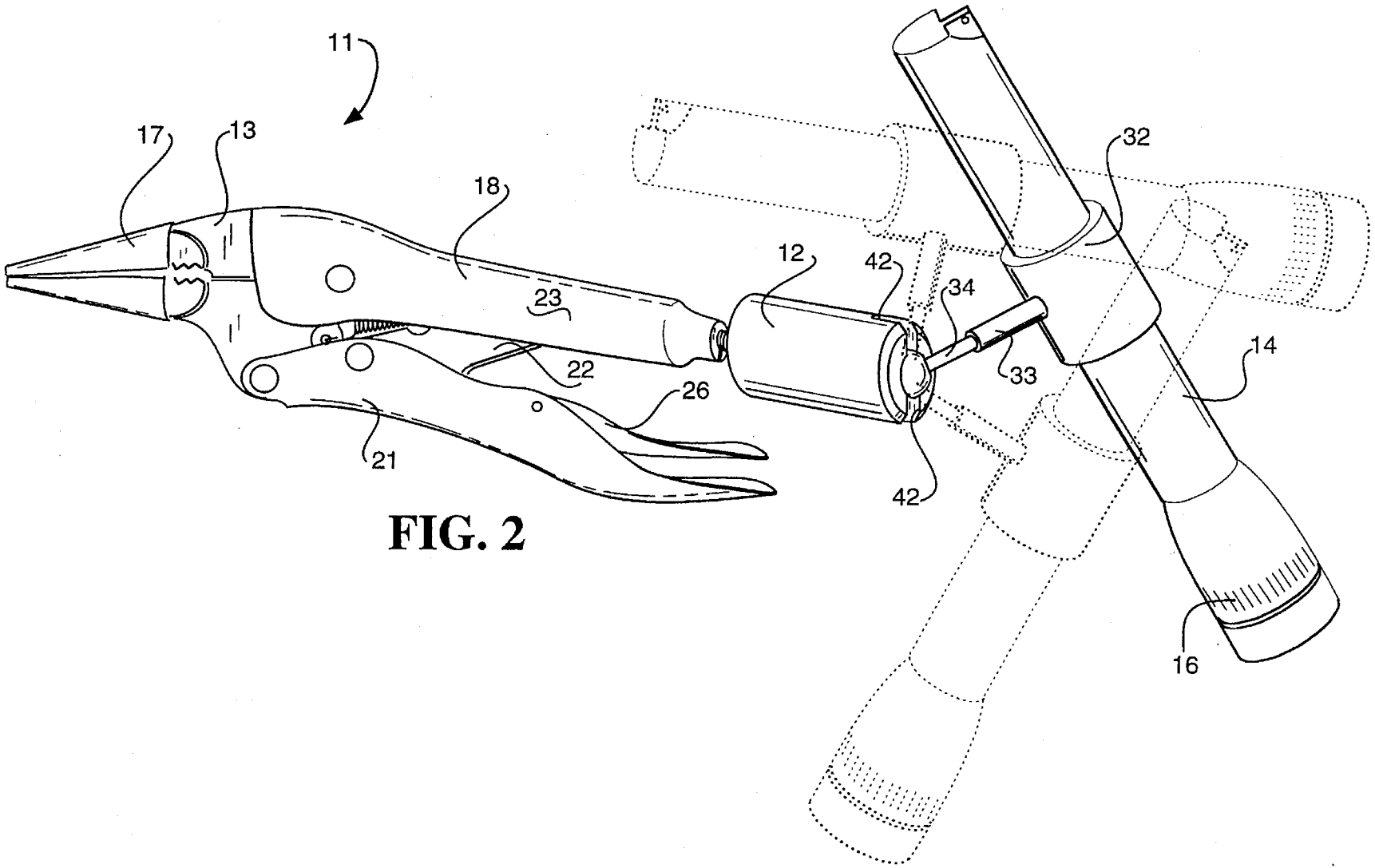
FIG. 2 is an enlarged side isometric view of the preferred embodiment of FIG. 1, showing in phantom alternate positions of the attachment mechanism of the connector.

A preferred embodiment of a holder of the invention is generally referred to in FIGS. 1–3 by the reference numeral 11. Such holder includes an adapter 12 to be described in more detail hereinafter, and a gripping device in the form in this embodiment of standard vise grip pliers 13. The adapter 12 is secured as indicated to a flashlight 14. Such flashlight includes an output end 16 from which a beam of illumination can shine to a location of an operation to be performed.

Vise grip pliers 13 are common and include a pair of opposing jaws 17 and a handle 18. (Such jaws may be covered as is illustrated.) As is common, the handle 18 includes a manipulatable hand trigger portion 21 which is suitably connected to lock the jaws 17 a desired distance apart with an over-center operation.

The distance between the jaws 17 at which manipulation of handle trigger portion 21 provides locking, can be adjusted in a standard way. In this connection, a lever 22 pivotally connected to trigger 21 extends into the "stationary" handle portion 23. The end of the lever 22 within handle portion 23 bears against the shank of a bolt 24 (see FIG. 3) which is threaded into the handle portion. In accordance with common arrangements of this nature, the location of the end of the shank in the handle and, hence, the end of the bar 22, determines the positioning of the jaws 17 relative to one another when the vise grip pliers are placed in a locked, set (handle 21 is placed in an over-center position) position. A release hand lever 26 is pivotally secured to the handle portion 21 in accordance with conventional practice to engage the lever 22 when depressed and move it toward the handle portion to aid in breaking an over-center lock.

It is to be noted that the use of vise grip pliers as a gripping device is particularly advantageous. Vise grip pliers take up a minimum of space. Moreover, the jaws of the same are connectable to many different structural configurations, including many that may not be grippable by other devices, i.e., those having minimum grippable configurations.

The adapter is designed so as not to interfere with use of the adjustment mechanism provided by the vise grip pliers. To this end, such adapter includes an interface unit 27 secured to the bolt 24. It represents the only connection between the pliers 13 and the adapter. Threaded receipt within the vise grip plier handle portion 23 of the shank of the bolt 24 is not obstructed. The head 29 of the bolt 24 fits tightly within interface unit 27 so that rotation of it also provides rotation of the bolt in a slavish manner. That is, such head is held within a cup 30 at one end of the interface unit 27 by an expanding key ring 35. A set screw 40 bears against such head, which set screw is accessible for tightening through a bore which extends through the interface unit as illustrated.

It will be seen that to adjust the pliers it is only necessary to rotate the interface unit. It should be noted that because of the smallness of the interface unit 27 it is not necessary to remove it from the vise grip pliers 17 whenever it is desired to use such vise grip pliers in the common way.

The connector has a sleeve 31, and a collar 32 circumscribing flashlight 14. The flashlight has a cylindrical outer surface as is illustrated which extends linearly of the same, and the collar 32 coaxially circumscribes such surface. The interior surface of the collar is provided with one or more O-rings to grasp the flashlight handle with a tight grip. It is desirable, though, that it not be tight enough to prevent an operator from forcibly sliding the flashlight axially within the collar to differing locations. Such adjustment of the positioning of the flashlight relative to the collar enables linear movement to change the distance between the flashlight output end 16 and the location to be illuminated. Thus, some change can be made in the focus of the flashlight relative to the location to be illuminated. While sleeve 31 could be of stainless steel or the like, it is preferred that it be of hard anodized aluminum. This will reduce its weight and, of course, make the adapter more cost efficient.

Figure 4:
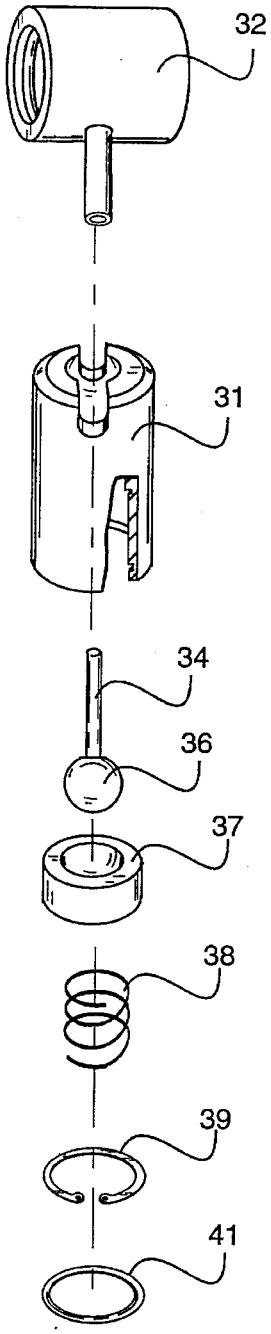
FIG. 4 is an exploded view illustrating a connector of the preferred embodiment of the invention of FIG. 1.

Collar 32 is connected to the sleeve 31 in such a way that its orientation and, hence, the orientation of the light relative to the vise grip pliers 13 can be changed. That is, a pin connection 33 projects radially from the exterior surface of the collar and one end of a pin 34 is received therein. The other end of the pin is connected to a ball (FIG. 4) 36 so that the pin projects radially from such ball. The ball 36 is part of a mating ball and socket structure or arrangement providing an orientation change mechanism for the adapter.

The orientation change of the mechanism enables the position of collar 32 and, hence, of the flashlight 14 relative to the vise grip pliers to be changed. A change is represented in FIG. 2 by a phantom representation of the structure. Sleeve 31 is relieved at the socket as shown at 42 in order to accommodate the pin 34 and let there be a full 180° orientation change of such pin. Moreover, this orientation change can be made over a full 360°. In this connection, the sleeve 31 is rotatable relative to the connector 28 for the full 360° so as to enable one to position the reliefs at 42 at any location in such 360° it is desired to accommodate the pin 34. As can be seen, such rotation of the connector is in a plane orthogonal to the mating ball and socket arrangement. Moreover, the 180° orientation change of the pin mentioned above includes 90° arcuate positioning of the connector relative to such plane. Thus, the combination of the mating ball and socket arrangement with the connector rotation provides a spherical (three-dimensional, not just two-dimensional) range of adjustment or, in other words, makes the adjustment of the flashlight 14 omni-directional.

While the ability to change the orientation of the flashlight is primarily to facilitate its aiming at a location to be illuminated, it will be appreciated that the orientation can be changed as is necessary when the adapter is being rotated relative to the vise grip pliers for adjustment of the latter. It is not necessary from the broad standpoint that there be separation of the connector from the vise grip pliers for such adjustment.

The socket is defined at one end of the sleeve 31 by both the sleeve 31 and by a disc 37. The disc 37 resiliently urges the ball against a concave hemisphere socket at such one end of the sleeve. That is, a spiral spring 38 is maintained in compression against the opposite surface of disc 37 by an expanding key ring 39.

The connector and the sleeve 31 are secured to one another via O-rings 41. While these O-rings inhibit separation between the sleeve and the connector, they do not stop it. Moreover, they permit the rotation discussed above when the orientation of the light or other instrumentality is being changed.

It will be appreciated from the above that vise grip pliers 13 are removable from most of the adapter to be used separately if desired. That is, it is only necessary to disengage the sleeve 31 from the interface unit 27. While the unit 27 will remain a part of the pliers, it is clear that it will not interfere with use of such vise grip pliers, including their adjustment. In this connection, the fact that the connector is securable directly to the adjustment mechanism aids in assuring that the entire adapter will not interfere with adjustment even when the connector and the flashlight are secured to the same.

FIG. 1 illustrates the holder maintaining a flashlight 14 in position to aim a beam of light at an area to be illuminated. In this connection, the flashlight 14 is linearly adjustable for focusing because of its sliding relationship to the collar.

Figure 5:
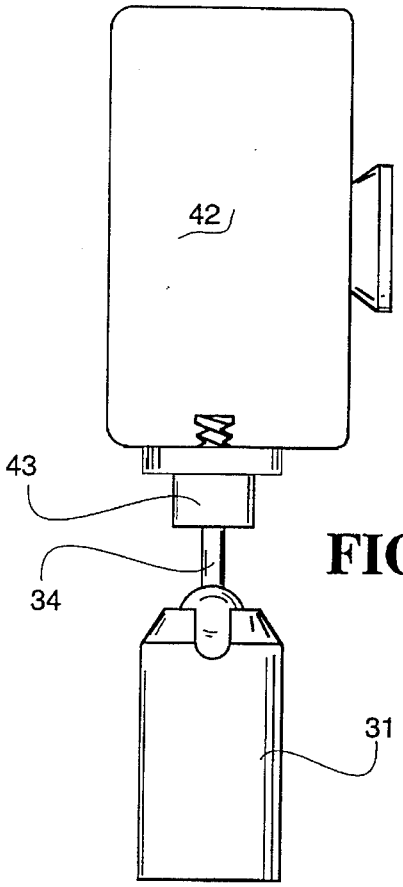
FIG. 5 is a sectional view illustrating use of the invention to mount a camera at a desired location.

As mentioned previously, it is not necessary that the tool to be held be a flashlight. The holder of the invention can be used with other tools. That is, the word "tool" is utilized in its broad sense in this patent application and encompasses cameras to record a scene, as well as devices, such as a screwdriver, which perform an operation at a scene. FIG. 5 illustrates a camera 42 being held in a desired location. An intermediary camera connector 43 is screwed into the camera 42 at the location typically provided for tripods, which connector 43 is secured to the end of pin 34.

The interface unit of the embodiment of FIG. 5 is the same as that of the embodiment previously described. (The vise grip pliers and their adjustment mechanism are not illustrated for simplicity.)

Figure 6:
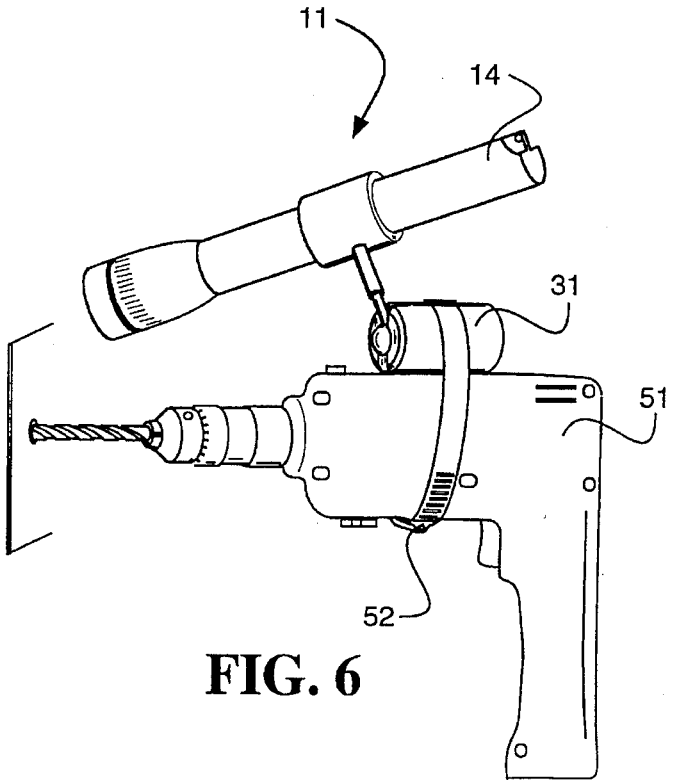
FIG. 6 is an isometric view illustrating use of the invention with a power drill.

It also is not necessary in all instances that the vise grip pliers 13 be a part of the device. For example, in those situations in which the adapter is securable directly to the tool, the tool can, in essence, replace the vise grip pliers. FIG. 6 is such an arrangement. It will be seen that the sleeve 31 and, hence, the full connector is securable to the drill body 51 itself by a strap 52 which circumscribes both the drill body and the connector. The flashlight 14 is thus held to focus light at the location at which the drill bit engages the workpiece as is illustrated.

As mentioned at the beginning of the detailed description, applicant is not limited to the specific embodiments described above. They are exemplary, rather than exhaustive. Various changes and modifications can be made. The claims, their equivalents and their equivalent language define the scope of protection.

What is claimed is:

1. An adapter facilitating the holding of an instrumentality at a desired location comprising, in combination:

(a) an interface unit securable to a gripping device which can grip a structure adjacent said location, said gripping device having a pair of jaws which are lockable in a set position relative to one another for gripping said structure and including an adjustment mechanism for changing the location of said lockable, set position, said adjustment mechanism having a projection and said interface unit being securable directly to said projection of said adjustment mechanism so as not to interfere with use of said adjustment mechanism; and (b) a connector for said instrumentality, attachable to said interface unit, said connector including an orientation change mechanism which enables the orientation of said instrumentality relative to said gripping device to be changed.

2. The adapter of claim 1 wherein said connector is rotably attached to said interface unit and said orientation change mechanism includes a mating ball and socket arrangement which is relieved at said socket to accommodate structure secured to said ball.

3. The adapter of claim 2 wherein said orientation change mechanism is configured to provide cooperation of said mating ball and socket arrangement with said rotatable connection of said connector unit and said interface unit to provide a full spherical range of adjustment of said instrumentality relative to said gripping device.

4. The adapter of claim 3 in which said rotation of said connector to said interface unit provides 360° rotation in a plane orthogonal to said mating ball and socket relieved arrangement and said arrangement enables at least 90° arcuate positioning of said connector relative to said plane.

5. The adapter of claim 1 wherein said instrumentality is a light source having an output end from which illumination can shine.

6. The adapter of claim 5 wherein said light source is a flashlight having a cylindrical surface extending linearly thereof and said attachment mechanism is a collar which circumscribes said surface coaxially therewith.

7. The adapter of claim 1 wherein both said gripping device and said instrumentality are part of said combination.

8. The adapter of claim 7 wherein said gripping device to which said interface unit is securable is a pair of vise grip pliers.

9. The illumination device of claim 1 wherein said gripping device to which said interface unit is securable is a pair of vise grip pliers.

10. The adapter of claim 1 wherein said interface unit is only connected to said adjustment mechanism at said projection, which projection is a head of a bolt that when rotated changes said set position.

11. A holder for maintaining a selected instrumentality at a desired location comprising, in combination:

(a) an adapter which is securable to said selected instrumentality; and (b) a gripping device to grip structure adjacent said location, which device is securable to said adapter and includes a pair of jaws which are lockable in a set position relative to one another for gripping said structure, said gripping device also having an adjustment mechanism for changing the location of said lockable, set position, which adjustment mechanism has a projection and said adapter is securable directly to said projection in a manner so as not to interfere with use of said adjustment mechanism.

12. The holder of claim 11 wherein said gripping device is a pair of vise grip pliers.

13. The holder of claim 11 wherein said adapter also comprises:

(b) a connector for said instrumentality, attachable to said interface unit.

14. The holder of claim 11 wherein said instrumentality is a light source having an output end from which illumination can shine, and said connector includes an attachment mechanism for said light source selected to permit movement of said light source linearly with respect to said attachment mechanism to change the distance between said output end and said location.

15. The holder of claim 11 wherein said adapter is only connected to said adjustment mechanism at said projection, which projection is a head of a bolt that when rotated changes said set position.

16. An illumination device for an operation to be performed by a tool adjacent grippable structure comprising, in combination:

(a) a portable light source;

(b) an adapter securable to said light source to hold said light source at a desired location during use of said tool; and (c) a gripping device adapted to grip said structure and being securable to said adapter, said gripping device having a pair of jaws which are lockable in a set position relative to one another for gripping said structure and including an adjustment mechanism for changing the location of said lockable, set position, said adjustment mechanism having a projection and said adapter being securable directly to said projection of said adjustment mechanism so as not to interfere with use of said adjustment mechanism.

17. The illumination device of claim 16 wherein said adapter includes a fastener for securing said illumination device to said tool.

18. The illumination device of claim 17 wherein said fastener is a strap to circumscribe said tool.

19. The illumination device of claim 16 wherein said adapter is only connected to said adjustment mechanism at said projection, which projection is a head of a bolt that when rotated changes said set position.

* * * * *